US007376053B2

(12) United States Patent
Leuba et al.

(10) Patent No.: US 7,376,053 B2
(45) Date of Patent: May 20, 2008

(54) USE OF NON-MAGNETIC PATHS FOR AN ELECTRONIC MODULE INTENDED FOR A TIMEPIECE

(75) Inventors: Frédéric Leuba, La Chaux-de-Fonds (CH); Denis Burdet, Neuchâtel (CH)

(73) Assignee: Eta SA Fabriques d'Ebauches, Grenchen (CH)

( * ) Notice: Subject to any disclaimer, the term of this patent is extended or adjusted under 35 U.S.C. 154(b) by 328 days.

(21) Appl. No.: 10/085,285

(22) Filed: Feb. 24, 2002

(65) Prior Publication Data

US 2002/0118607 A1 Aug. 29, 2002

(30) Foreign Application Priority Data

Feb. 28, 2001 (CH) ..... 0367/01

(51) Int. Cl.
*G04B 37/00* (2006.01)
*G04C 21/00* (2006.01)

(52) U.S. Cl. ..... 368/88; 368/250

(58) Field of Classification Search ..... 368/126, 368/162–164, 250; 310/40 MM, 156, 162, 310/184, 180, 194, 179, 254, 268
See application file for complete search history.

(56) References Cited

U.S. PATENT DOCUMENTS 3,937,001 A 2/1976 Berney
4,176,362 A * 11/1979 Nelson ..... 346/74.5
5,569,545 A * 10/1996 Yokono et al. ..... 428/626
5,667,879 A * 9/1997 Haji-Sheikh ..... 428/209
6,124,649 A * 9/2000 Schafroth ..... 310/40 MM
6,562,709 B1 * 5/2003 Lin ..... 438/618

FOREIGN PATENT DOCUMENTS

| | | |
|---|---|---|
| CH | 597636 | 4/1978 |
| EP | 0 425 691 A1 | 5/1991 |
| EP | 0 851 322 A1 | 7/1998 |

* cited by examiner

*Primary Examiner*—P. Austin Bradley
*Assistant Examiner*—Thanh S. Phan
(74) *Attorney, Agent, or Firm*—Griffin & Szipl, P.C.

(57) ABSTRACT

The present invention proposes improving the yield of a microgenerator (1) used for operating a timepiece. Such a microgenerator operates on the basis of the phenomenon of electromagnetic induction, it is thus desirable to limit as far as possible the presence of magnetic masses in proximity to said generator. Research undertaken has shown that the electrically conductive paths (9), and even their single protective layer, arranged in proximity to the microgenerator brake it, when they are formed of a magnetic material, and in particular a ferromagnetic material. Thus, the selection of exclusively non-magnetic materials is proposed for manufacturing the conductive paths.

19 Claims, 2 Drawing Sheets

USE OF NON-MAGNETIC PATHS FOR AN ELECTRONIC MODULE INTENDED FOR A TIMEPIECE

BACKGROUND OF THE INVENTION

This application claims priority from Swiss Patent Application No. 0367/01, filed Feb. 28, 2001.

The present invention concerns a timepiece including in particular a functional unit including magnetised masses, an electronic module including a support with conductive paths connected to at least one integrated circuit.

In particular, the object of the present Application concerns a timepiece wherein said functional unit is a microgenerator which is not shielded laterally.

Hereinafter in this Application, "non-magnetic" material means a material which is not ferromagnetic, which is not or only very slightly paramagnetic, and which may have a slight diamagnetism. Likewise, "in proximity to the microgenerator" means the entire peripheral region of the microgenerator in which the magnetic flux of the magnetised masses has a significant value.

The operating principle of such a watch movement is described in particular in Swiss Patent No. 597636 and European Patent No. 851322, the teaching of which is incorporated herein by reference. Swiss Patent No. 597636, for example, discloses a watch movement wherein a spring, via a set of gears, drives hands, on the one hand, and a generator generating an ac current, on the other hand. The generator powers an electronic circuit including in particular a stabilised quartz oscillator which allows the working of the generator, and thus the working of the hands, to be regulated. Such a watch consequently combines the advantages of a mechanical watch with the precision of a quartz watch.

SUMMARY OF THE INVENTION

However, while seeking to develop a product of this type, the Applicant observed the existence of sources of magnetic disturbance within the watch movement. Indeed, the advantage of such a timepiece increases when its energy consumption decreases, i.e. when for example the generator yield increases. Starting from this observation, the Applicant has proved that ferromagnetic masses located in proximity to the generator exert a parasitic magnetic force on it, thus decreasing its yield.

The object of the present invention is thus to improve the aforementioned type of timepiece while avoiding the drawbacks described above, in particular owing to a simple improvement which is inexpensive to manufacture.

The invention thus concerns a timepiece of the type indicated hereinbefore characterised in that at least the conductive paths located in proximity to said functional unit have non-magnetic properties.

In a particular embodiment, said conductive paths include a layer of a good electrically conductive material deposited on the substrate of the printed circuit and surmounted by a protective layer. This protective layer is also made of a non-magnetic material, in accordance with the present invention, preferably a nickel based non-magnetic material.

According to another embodiment of the invention, the conductive paths further include an underlayer intended to improve the adherence of the layer of good electrically conductive material on the printed circuit substrate. This underlayer is preferably made of a nickel based non-magnetic material.

The invention will be explained in more detail with the aid of the following description of an example embodiment made with reference to FIG. 1 which is a simplified top view of the movement partially mounted in a timepiece including a generator.

DETAILED DESCRIPTION OF THE INVENTION

Figure 1:
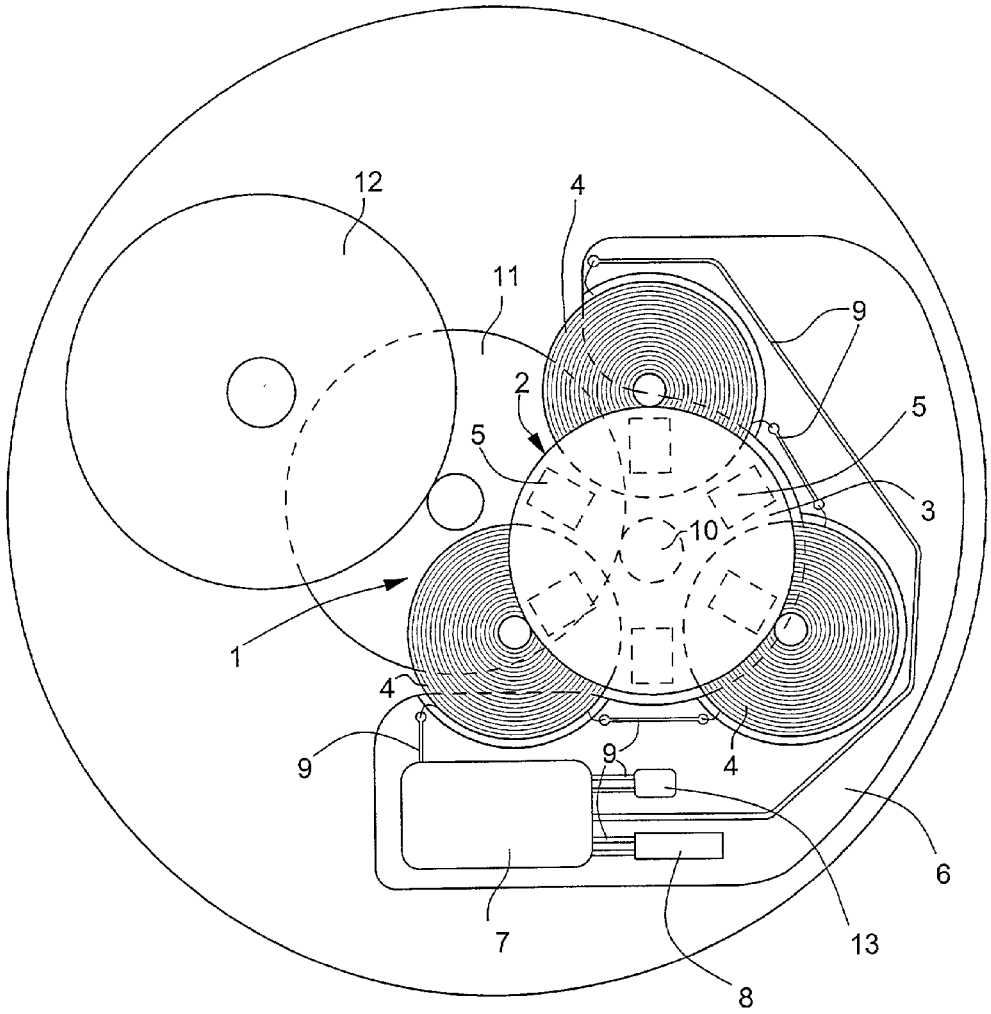
FIG. 1 shows a view of the generator 1, including a rotor 2 having two flanges 3, only one of which is shown, arranged on either side of three flat coils 4 forming the stator and offset substantially by 120 degrees in relation to each other relative to the axis of rotor 2, in a same orthogonal plane as the latter

Six magnets 5 are fixed radially and at regular intervals on each flange 3, facing coils 4. The polarity of two consecutive magnets 5 is opposite. Moreover, the faces facing each other of the superposed magnets 5 have opposite polarities. A printed circuit 6 acts as a support in particular for coils 4, for an integrated circuit 7, for a quartz 8 and for electrically conductive paths 9.

Low power consuming integrated circuit 7 is powered by electric generator 1—formed of the assembly of arbour 10 of rotor 2, flanges 3, magnets 5 and coils 4—driven via a kinematic link 11 by a barrel device 12. The mechanical energy stored in barrel 12 thus drives rotor 2. The passage of magnets 5 in proximity to coils 4 generates a substantially sinusoidal induced voltage across the terminals of the coils.

The Figure shows that electrically conductive paths 9 carried by electronic module 6 are present over a large part of the periphery of generator 1 and thus in proximity to magnets 5 of rotor 2.

Figure 2:
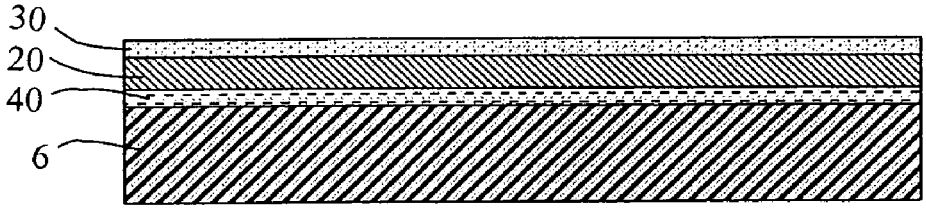
FIG. 2 is a cross sectional view through a conductive path on substrate 6.

As in the prior art, the electrically conductive paths 9 of FIG. 1 are typically made in two steps. The first step consists in depositing a layer 20 of a very good electrically conductive material, such as copper or gold based alloy. The second step then consists in depositing a fine protective layer 30, on the conductive layer 20, formed of a nickel based alloy with good resistance to oxidisation. Sometimes an underlayer 40 is deposited on the substrate 6 before depositing the conductive layer 20 as illustrated in FIG. 2. This underlayer 40, usually formed of a nickel based alloy, allows the adherence of the conductive layer 20 to the substrate 6 to be improved. It will be noted that the nickel based underlayer 40 also acts as a barrier against the diffusion of the metal from the conductive layer 20 in the direction of the support 6.

Within the scope of the present invention, it was shown that the nickel based alloy usually used to form the protective layer has ferromagnetic properties.

The Applicant observed, during his research work, that despite the small dimensions of electrically conductive paths 9, they disturb the operation of generator 1 when they have magnetic properties and are located in the peripheral regions of said generator.

Surprisingly, research has shown that even when the conductive layer is made of gold or copper, which are non-magnetic metals, the single nickel based ferromagnetic protective layer decreases the generator yield and thus the power-reserve available for the timepiece.

Indeed, because of its ferromagnetic properties, the conventional nickel based alloy may, via the effect of the magnetic field, pick up in part the magnetic flux from rotating magnets 5, which brakes the generator.

The solution to the aforecited problem thus consists in only using materials which do not have ferromagnetic properties to make the electrically conductive paths, in particular for making the protective layer.

One may, in particular, use a nickel based alloy containing phosphorus for this purpose, since for certain values of its composition the alloy obtained does not have magnetic properties. One could use other materials to replace the nickel, such as palladium for example certain alloys of which also have non-magnetic properties.

It should be noted that the reasoning hereinbefore can also be applied in the event that the electrically conductive paths comprise an adherence underlayer. Said underlayer is then preferably made of a nickel based non-magnetic alloy.

Since the making of electronic module 6 does not itself form the core of the invention, it will not be developed in more detail in the present Application. Those skilled in the art can refer in particular to U.S. Pat. No. 5,569,545 disclosing examples of alloys used in the printed circuit design.

According to a variant of the invention, all of paths 9 can be made of one or more materials which do not have magnetic properties, resulting in a simplification of the manufacturing process of electronic module 6.

According to a variant of the invention, in the event that electronic module 6 also carries discrete electronic elements, such as a capacitor 13, said discrete electronic elements may also be exclusively formed of materials with essentially non-magnetic properties.

Multiple applications may be imagined in the horological field, for selecting entirely non-magnetic paths according to the invention. Indeed, the use of said paths was described in the case of a timepiece operating with a generator, but one may also use such paths in any other type of timepiece with sensitivity to magnetic disturbance. The invention may in particular be implemented in a timepiece whose functional unit is a compass, or in any other type of timepiece implementing means interacting with an external magnetic field, in particular for the purpose of detecting it.

What is claimed is:

1. A timepiece including:

a functional unit including magnetised masses; and an electronic module including a support with conductive paths connected to at least one integrated circuit, wherein at least those conductive paths located in proximity to the functional unit are made of essentially non-magnetic material, wherein the conductive paths include a protective layer formed of a non-magnetic material selected from the group consisting of a nickel based alloy containing phosphorous and a palladium based alloy, and wherein those conductive paths located in proximity to the functional unit do not disturb operation of the functional unit.

2. A timepiece according to claim 1, wherein said electronic module further includes at least a discrete electronic unit, and said discrete electronic unit is exclusively formed of essentially non-magnetic materials.

3. A timepiece according to claim 2, wherein said functional unit is a microgenerator.

4. A timepiece as recited in claim 2, wherein the electronic unit is a capacitor.

5. A timepiece according to claim 3, wherein said microgenerator includes a rotor including two flanges, each flange having substantially the shape of a disc and each flange carrying, on a face facing the other flange, an even number of magnetised masses; and wherein said electronic module includes at least a stator coil fixed to said support and partially inserted between the two flanges, the conductive paths of said support connecting said at least one coil to said integrated circuit.

6. A timepiece according to claim 1, wherein said conductive paths include an adherence underlayer formed of a non-magnetic material.

7. A timepiece according to claim 6, wherein said adherence underlayer is made of a nickel based alloy.

8. A timepiece according to claim 6, wherein said functional unit is a microgenerator.

9. A timepiece according to claim 1, wherein said functional unit is a microgenerator.

10. A timepiece according to claim 9, wherein said microgenerator includes a rotor including two flanges, each flange having substantially the shape of a disc and each flange carrying, on a face facing the other flange, an even number of magnetised masses; and wherein said electronic module includes at least a stator coil fixed to said support and partially inserted between the two flanges, the conductive paths of said support connecting said at least one coil to said integrated circuit.

11. A timepiece according to claim 1, wherein said electronic module further includes at least one capacitor, wherein said at least one capacitor is exclusively formed of essentially non-magnetic materials.

12. A timepiece according to claim 11, wherein said functional unit is a microgenerator.

13. A timepiece including:

a microgenerator including magnetised masses; and an electronic module including a support with conductive paths connected to at least one integrated circuit and to the microgenerator, wherein the conductive paths are made of essentially non-magnetic material selected from the group consisting of a nickel based alloy containing phosphorous and a palladium based alloy, and wherein conductive paths disposed in proximity to the microgenerator do not disturb operation of the microgenerator.

14. A timepiece according to claim 13, wherein said electronic module further includes at least a discrete electronic unit, and said discrete electronic unit is exclusively formed of essentially non-magnetic materials.

15. A timepiece as recited in claim 14, wherein the electronic unit is a capacitor.

16. A timepiece according to claim 13, wherein said conductive paths include an adherence underlayer formed of a non-magnetic material.

17. A timepiece according to claim 16, wherein said adherence underlayer is made of a nickel based alloy.

18. A timepiece including:

a microgenerator including magnetised masses; and an electronic module including a support with conductive paths connected to at least one integrated circuit and to the microgenerator, wherein the conductive paths are made of essentially non-magnetic material selected from the group consisting of a nickel based alloy containing phosphorous and a palladium based alloy, and wherein conductive paths disposed in proximity to the microgenerator are non-magnetic and do not disturb operation of the microgenerator and do not brake the microgenerator.

19. A timepiece including:

a functional unit including magnetised masses, wherein the functional unit is a microgenerator; and an electronic module including a support with conductive paths connected to at least one integrated circuit, wherein at least those conductive paths located in proximity to the functional unit are made of essentially non-magnetic material, wherein the conductive paths include a protective layer formed of non-magnetic material selected from the group consisting of a nickel based alloy containing phosphorous and a palladium based alloy, and wherein those conductive paths located in proximity to the functional unit are non-magnetic and do not disturb operation of the functional unit and do not brake the functional unit.

* * * * *